US005332191A

United States Patent [19]

Nolan

[11] Patent Number: 5,332,191

[45] Date of Patent: Jul. 26, 1994

[54] APPARATUS FOR MAKING CONCRETE SLABS

[76] Inventor: Terry L. Nolan, P.O. Box 367, Humboldt, Ariz. 86329

[21] Appl. No.: 966,517

[22] Filed: Oct. 26, 1992

[51] Int. Cl.[5] ..... B28B 7/04

[52] U.S. Cl. ..... 249/155; 249/156; 249/157; 249/158; 249/165; 249/166; 249/1; 249/2; 249/9; 249/98; 249/99; 249/101; 249/15; 249/16; 249/4; 249/5

[58] Field of Search ..... 249/155, 156, 157, 158, 249/165, 166, 1, 2, 9, 98, 99, 101, 15, 16, 2, 4, 5

[56] References Cited

U.S. PATENT DOCUMENTS

| | | | |
|---|---|---|---|
| 896,330 | 8/1908 | Scheelky | 249/9 X |
| 1,099,010 | 6/1914 | Bock et al. | 249/155 |
| 1,220,526 | 3/1917 | Marshall | 249/101 |
| 1,339,912 | 5/1920 | Ambursen . | |
| 1,379,457 | 5/1921 | Loxterman | 249/9 X |
| 1,622,103 | 3/1927 | Fulton | 249/9 X |
| 1,690,462 | 11/1928 | Smith | 249/99 X |
| 1,891,513 | 12/1932 | Venzie | 249/9 X |
| 1,974,130 | 9/1934 | Wedberg | 20/7 |
| 2,305,804 | 12/1942 | Bentz et al. | 94/3 |
| 2,557,631 | 6/1951 | Callan | 25/128 |
| 2,636,426 | 4/1953 | Heltzel | 249/9 |
| 2,644,997 | 7/1953 | Billings | 249/99 |
| 2,722,045 | 11/1955 | Yates et al. | 25/118 |
| 2,745,165 | 5/1956 | Lewis | 25/118 |
| 2,867,887 | 1/1959 | Ratcliffe | 249/99 X |
| 3,166,815 | 1/1965 | Rappas | 249/9 |
| 3,288,426 | 11/1966 | Simpson | 249/192 |
| 3,420,014 | 1/1969 | Courtois et al. | 52/173 |
| 3,431,012 | 3/1969 | Courtois et al. | 294/86 |
| 3,477,684 | 11/1969 | Dagiel | 249/189 |
| 3,491,680 | 1/1970 | Smith | 25/41 |
| 3,495,800 | 2/1970 | Fisher | 249/20 |
| 3,590,538 | 7/1971 | Holt | 52/127 |
| 3,596,971 | 8/1971 | Courtois et al. | 294/89 |
| 3,621,626 | 11/1971 | Tybius | 52/227 |
| 3,643,909 | 2/1972 | Brosseau | 249/41 |
| 3,652,118 | 3/1972 | Goldberg | 294/89 |
| 3,689,024 | 9/1972 | Notzel | 249/189 |
| 3,693,927 | 9/1972 | Jennings | 249/11 |
| 3,722,162 | 3/1973 | Ludvigsen | 52/608 |
| 3,732,052 | 5/1973 | Gunia | 425/219 |
| 3,763,613 | 10/1973 | Wise | 52/447 |
| 3,780,977 | 12/1973 | Dasheu | 249/15 |
| 3,842,562 | 10/1974 | Daigle | 52/583 |
| 3,923,410 | 12/1975 | Jordan et al. | 404/41 |
| 3,955,907 | 5/1976 | Yamasita et al. | 425/130 |
| 3,963,210 | 6/1976 | Macklin | 249/230 |
| 4,017,115 | 4/1977 | Holt et al. | 294/89 |
| 4,052,031 | 10/1977 | Melfi | 249/19 |
| 4,121,804 | 10/1978 | O'Leary | 249/157 |
| 4,158,533 | 6/1979 | Longinotti | 425/139 |
| 4,159,100 | 6/1979 | Landowski | 249/99 |
| 4,260,126 | 4/1981 | Schreck et al. | 249/20 |
| 4,274,240 | 6/1981 | Soum | 52/583 |
| 4,321,024 | 3/1982 | Terraillon | 425/111 |
| 4,325,575 | 4/1982 | Holt et al. | 294/89 |
| 4,386,486 | 6/1983 | Holt et al. | 52/125.5 |
| 4,387,877 | 6/1983 | Deason | 249/9 |
| 4,451,022 | 5/1984 | Sauger | 249/2 |
| 4,455,104 | 6/1984 | Weisbach | 404/50 |
| 4,455,269 | 6/1984 | Spamer et al. | 264/31 |
| 4,591,474 | 5/1986 | Scott et al. | 264/253 |
| 4,850,739 | 7/1989 | Gargollo | 404/41 |
| 4,884,958 | 12/1989 | Lowndes, III et al. | 425/62 |
| 4,969,626 | 11/1990 | Strauch | 249/94 |
| 5,051,023 | 9/1991 | Yoshida et al. | 404/39 |
| 5,065,558 | 11/1991 | Boatsman | 52/239 |
| 5,125,616 | 6/1992 | Rothenbuehler et al. | 249/3 |
| 5,133,620 | 7/1992 | Scheiwiller | 404/37 |

FOREIGN PATENT DOCUMENTS

| | | | |
|---|---|---|---|
| 2720577 | 9/1978 | Fed. Rep. of Germany | 249/101 X |
| 0006114 | of 1913 | United Kingdom . | |

*Primary Examiner*—James C. Housel
*Assistant Examiner*—Harold Y. Pyon
*Attorney, Agent, or Firm*—Charles E. Cates

[57] ABSTRACT

Adjustable forms for pouring precast concrete slabs and similar articles of manufacture. The forms may be used either on site to produce concrete slabs as needed, or at a central manufacturing location, for transport to the site where needed. Concrete slabs produced with the adjustable forms may be used in patios, sidewalks, storage room or pump house floors, driveways, mobile home landings, and the like. The slabs may be steel reinforced, with expandable interlocking design, of various sizes, patterns and colors. Similar construction materials or decorative articles, such as tile, wallboard, and the like may also be produced with the improved forms.

14 Claims, 3 Drawing Sheets

APPARATUS FOR MAKING CONCRETE SLABS

FIELD OF THE INVENTION

This invention relates generally to adjustable forms for pouring precast concrete slabs and similar articles of manufacture. The forms may be used either on site to produce concrete slabs as needed, or at a central manufacturing location, for transport to the site where needed. Concrete slabs produced with the adjustable forms may be used in patios, sidewalks, storage room or pump house floors, driveways, mobile home landings, and the like. The slabs may be steel reinforced, with expandable interlocking design, of various sizes, patterns and colors. Similar construction materials or decorative articles, such as tile, wallboard, and the like may also be produced with the improved forms.

BACKGROUND OF THE INVENTION

Forms for the production of precast concrete slabs have traditionally made of wood, and while the wooden forms have the advantage that they can be cut and nailed to a desired form size, they have the known disadvantage of requiring considerable time, labor and expense in the assembling and lining for each dimensional job and also in the dismantling after the concrete has properly set. Further, the constant cutting, nailing and re-nailing limits the number of times the forms can be re-used.

Forms made of other materials, such as steel, aluminum or other metals, have also been used. However, whereas the metal is more durable than the wood, the disadvantage is that the inability to cut the forms to size requires maintaining a large inventory of forms of varying size, or in the alternative developing telescoping and locking arrangements requiring multiple section sizes and movable parts for locking and anchoring. Efforts to avoid the use of wooden forms are disclosed for example in U.S. Pat. Nos. 2,722,045; 3,495,800; and 4,121,804.

It is an object of the present invention to provide an adjustable form which substantially overcomes the several problems referred to above in connection with prior wooden and metal forms.

It is another object of the invention to provide forms which may be adjusted to varying sizes but which are assembled from components all of which have identical size and configuration, so that stockpiling of multiple form components is unnecessary.

It is a further object of the invention to provide forms which are versatile in the production of concrete slabs or other construction materials of varying sizes, patterns and colors, and with varying edge-interlocking configurations.

It is a still further object to provide forms which are simple to assemble and disassemble, which are durable and can be reused indefinitely, and which avoid the wastage and inefficiency of the prior art forms.

Other objects and advantages will become apparent as the specification proceeds.

SUMMARY OF THE INVENTION

The present invention relates to an adjustable form for producing concrete slabs comprising a plurality of like channel shaped sections similarly oriented in interlocking arrangement to define a form unit. Each section includes vertically spaced upper and lower arms with a vertical web connecting corresponding ends of said arms. Each section also includes a main body and a fork joint extension thereof on at least one end. The fork joint extension comprises upper and lower tines spaced apart at a distance substantially equal to the cross-sectional depth of said sections, so that an end of an adjoining section may be accepted between said tines.

The upper and lower tines are each provided with opposing holes in vertical registration with each other, the holes being spaced apart from the end of said main section body for a distance substantially equal to the effective cross-sectional width of an adjoining section, so that the adjoining section may be accepted between the end of said main body and said holes. Pins are disposed through said opposing holes in the tines in each section, for retaining the adjoining section which is accepted between the tines. The interlocking arrangement of said plurality of sections is one in which the body of each section is inserted, at a predetermined point along its body, in a fork-jointed end of an adjoining section, to provide an enclosed geometric figure having predetermined dimensions.

In a preferred embodiment of the invention, four of the sections are assembled to provide a rectangular geometric figure for the concrete slab.

In a preferred version, the inner walls of the sections are provided with rabbet-forming shoulders, so that the resulting concrete slabs may be joined together in shiplapping fashion.

BRIEF DESCRIPTION OF THE DRAWINGS

The objects, features and advantages of the invention will be apparent to those skilled in the art from the description contained herein, taken together with the accompanying drawings, in which.

DETAILED DESCRIPTION OF THE INVENTION

Figure 1:
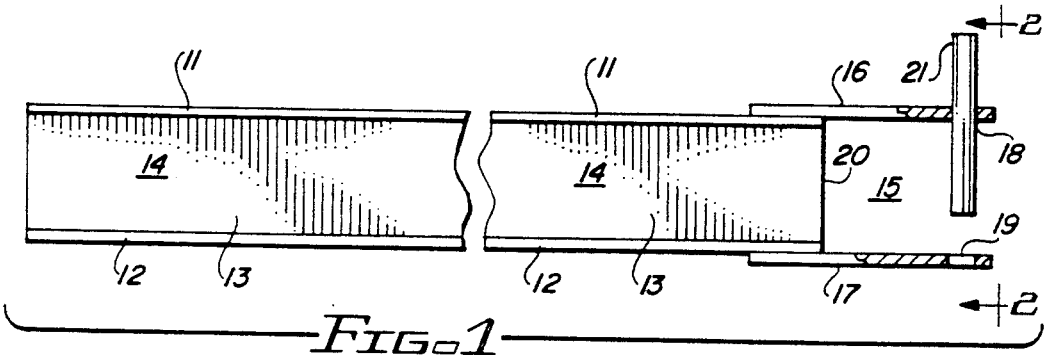
FIG. 1 is a side elevational view of one of the form sections of the present invention, showing the main body of the section and the fork joint extension thereof.
Figure 2:
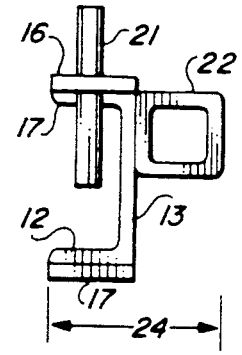
FIG. 2 is an end view of the form section, taken along line 2—2 of FIG. 1.

Referring to the drawings, one of the channel-shaped form sections used in the invention is illustrated in FIGS. 1 and 2. As indicated, the form section is channel-shaped in cross-section and comprises vertically spaced upper and lower arms, 11 and 12, connected by a vertical web 13. The section is composed of a main body portion 14 and a fork joint extension 15, which extends beyond the end 20 of the main body portion 14. The fork joint extension comprises an upper tine 16 and a lower tine 17 which are welded or otherwise fastened to the upper arm 11 and lower arm 12 respectively. Tines 16 and 17 are provided with opposing holes 18 and 19 which are in vertical registration with each other. The drift pin 21 may be inserted through holes 18 and 19 to retain the main body portion of an adjoining section in the fork joint extension 15.

As will be described hereinafter, all the sections used in an assembled form are identical to each other, and may be made of any suitable material, such as steel, aluminum or wood. Although wood has less enduring characteristics, it would be more durable in the present invention than the wood used in prior art forms, since in the present invention there is no need for cutting, nailing or renailing. The form sections may have any suitable dimensions. In a preferred embodiment, they are 12 feet long and have a depth of 4 inches, for the production of a 4 inch thick slab of concrete.

Figure 3:
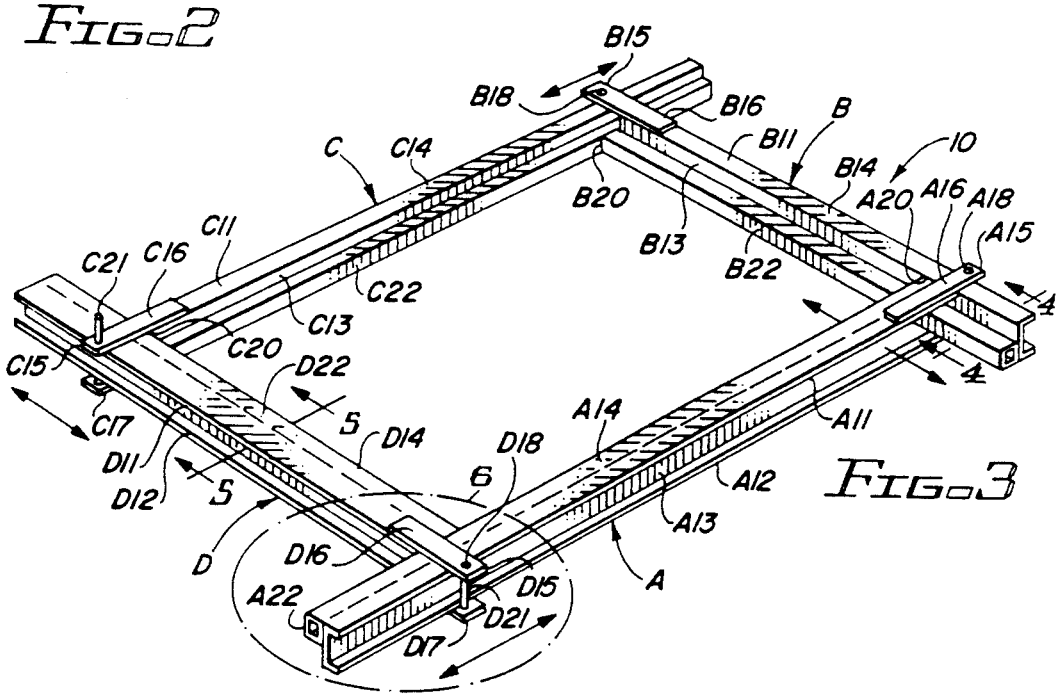
FIG. 3 is a perspective view of the adjustable form of the present invention, shown in its assembled state.

The assembled form 10 of the invention is shown generally in FIG. 3. In this embodiment, the form 10 is assembled from four channel-shaped sections, identified as A, B, C and D. For clarity in description, the various parts of these forms sections will be identified with an A, B, C or D prefix, so that the manner in which they fit together can be understood. Thus, Section A includes parts A11 through A22, and so on.

Figure 4:
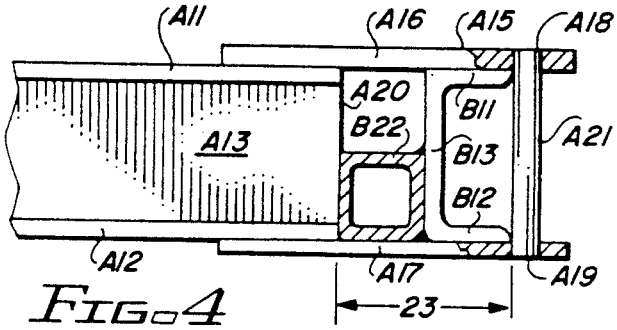
FIG. 4 is a cross-sectional view of a corner joint, taken along line 4—4 of FIG. 3.

In the fork joint extensions of each of the Sections, the tines 16 and 17 are spaced apart at a distance substantially equal to the cross-sectional depth of the Sections. Thus, in Section A, tines A16 and A17 are spaced apart substantially the same distance as the depth of Section B, so that the main body portion of Section B may be accepted between the tines, as shown in FIGS. 3 and 4. Setting the appropriate distance between tines A16 and A17 may be most readily accomplished by welding or otherwise fastening a plate-like tine A16 on top of arm A11 and extending beyond the end A20 of Section A, and by similarly welding a plate-like tine A17 on the bottom surface of arm A12 and extending beyond the end A20 of Section A, so that the distance between the inside surfaces of the two tines is substantially the same as the cross-sectional depth of Section A (and also Section B), so that Section B may be accepted between the tines with a frictional fit.

In the preferred embodiment of the invention shown in FIGS. 1 through 9, rabbet-forming shoulders are welded or otherwise fastened along the length of the inwardly facing surface of web 13. "Inwardly facing" is intended to mean the surface which faces inwardly toward the geometric figure being formed, or in other words the surface which will be contacted by the cement when it is poured. Thus, Sections A and D have rabbet-forming shoulders or tubes A22 and D22, respectively, affixed along the top edges of webs A13 and D13, respectively, to provide top surfaces flush with the top surfaces of arms A11 and D11, respectively (see FIGS. 6 and 5), whereas Sections B and C have rabbet-forming shoulders B22 and C22 affixed along the bottom edges of webs B13 and C13 (see FIG. 4). This arrangement is useful in producing concrete slabs which may be interlocked through undercut and overcut edges in shiplapping fashion.

In the fork joint extensions of each of the Sections, the holes 18 and 19 are spaced apart from the end 20 of the body portion 14 for a distance substantially equal to the effective cross-sectional width of an adjoining Section, so that the adjoining Section may be accepted between the end 20 of the main body portion 14 and the said holes 18 and 19 when the pin 21 is inserted therein. Thus, in FIG. 4, the effective cross-sectional width of Section B is shown by the numeral 23, which represents the horizontal dimension of tube or shoulder B22 added to the horizontal dimension of arm B12. The numeral 23 likewise represents the distance between the end 20 of main body portion A14 and the holes A18 and A19. When pin A21 is inserted in holes A18 and A19, the main body portion of Section B is accepted between pin A21 and end A20 on a substantially friction-fit basis. In similar manner, the effective width of Section A is identified by the numeral 24 in FIG. 6.

The effective cross-sectional width of an adjoining Section may be different if a concrete slab having a geometric figure other than a rectangle is being produced. For example, for a hexagonal figure, the angle at which the body of an adjoining Section is accepted by the fork joint extension will be greater, and a greater distance between the holes 18 and 19 and the end 20 of the body portion will be required. If desired, multiple registering holes may be installed in the tine members 16 and 17 at varying distances from the end 20, to accommodate the insertion of adjoining Section body members at different angles.

It is a feature of the invention that all the Sections are identical to each other in size and configuration, thus eliminating the expense and inefficiency of inventorying and handling many different forms that have been tailored to the production of many different sizes and shapes of concrete slabs. Although it might appear (as in FIG.3) that Sections A and C are not identical, since in Section A the rabbet-forming shoulder A22 is at the top of web A13, and in Section C the shoulder C22 is at the bottom, it should be understood that Sections A and C are in fact identical, and that Section C has only been flip-flopped in position with respect to Section A.

Figure 8:
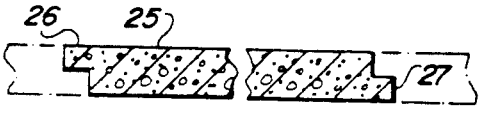
FIG. 8 is a cross-sectional view of the concrete slab, taken along line 8—8 of FIG. 7.
Figure 9:
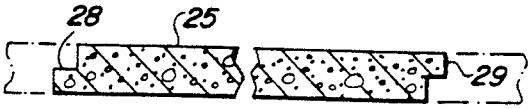
FIG. 9 is a cross-sectional view of the concrete slab, taken along line 9—9 of FIG. 7.
Figure 5:
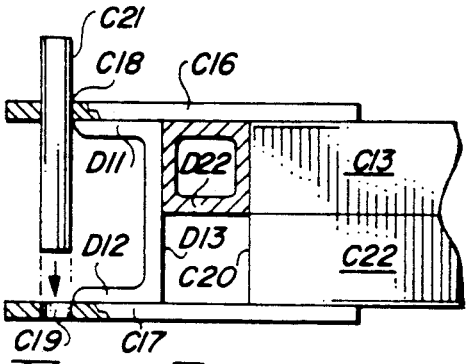
FIG. 5 is a cross-sectional view of an opposing corner joint, taken along line 5—5 of FIG. 3.
Figure 6:
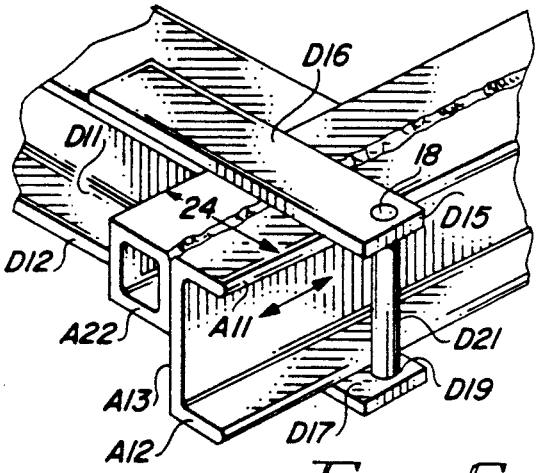
FIG. 6 is an enlarged perspective view of the corner joint contained in the circled area 6 in FIG. 3.
Figure 7:
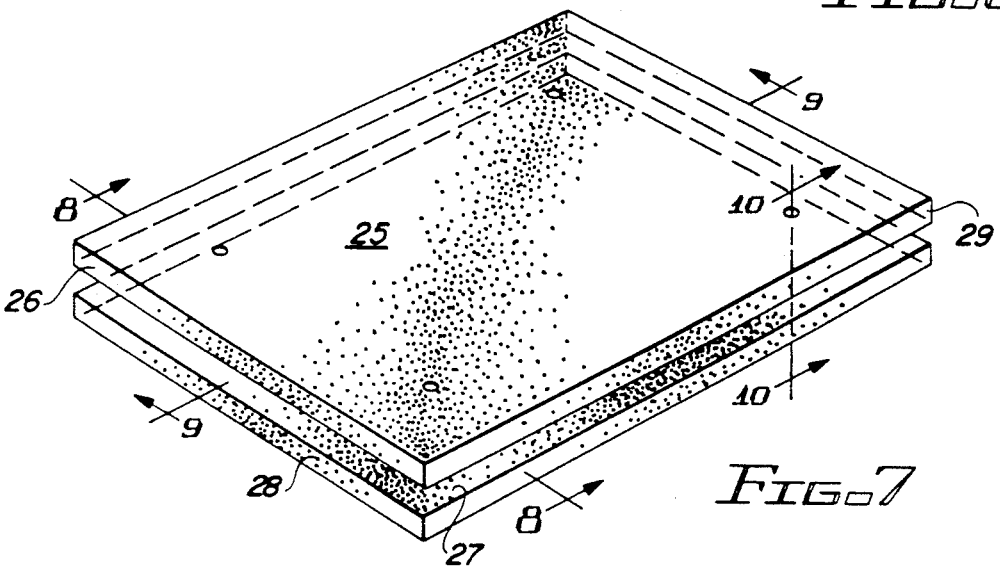
FIG. 7 is a perspective view of a concrete slab produced by use of the adjustable form illustrated in FIGS. 1 through 6.

FIG. 7 illustrates a precast concrete slab 25 which may be produced by pouring cement into the form illustrated in FIG. 3 and allowing to set. Although the slab appears to have top and bottom sections, it is in reality a single piece of concrete having two undercut edges and two overcut edges, thereby providing rabbets useful in laying multiple slabs in interlocking arrangement, in a shiplapping fashion. FIG. 8 is a cross-sectional view of slab 25 taken along line 8—8 of FIG. 7, showing rabbets 26 and 27. FIG. 9 is a cross-sectional view of slab 25 taken along line 9—9 of FIG. 7, showing rabbets 28 and 29. According to the present invention, the slabs may be cast in any convenient length and width. Standard dimensions include 5'×5', 6'×6', 8'×10', 9'×11', etc.

The procedure for producing a precast concrete slab 25 as shown in FIG. 7, using the adjustable form arrangement shown in FIGS. 1 through 6, is described as follows. As the first step, a sand base is prepared and leveled. For a 9'×11' concrete slab, the standard procedure is to provide a sand base approximately 12'×14' in area. Four of the form Sections of the present invention are then assembled on top of the sand base. Each of the sections is 12' in length, and has a depth from top to bottom of 4 inches. The sections are assembled by inserting the body of Section B in the fork joint extension of Section A, the body of Section C in the fork joint extension of Section B, and so on. The fork joint of each Section is slipped along the body of the adjoining Section until the desired area dimension is achieved, and then drift pins 21 are driven through the registered holes 18 and 19 in the fork joints of each of the Sections to lock the form to the desired dimension. The resulting assembly is shown in FIG. 3.

For most purposes, a large concrete slab, which can weigh as much as 3,000 pounds, will require internal reinforcement, such as rebar, and also eyebolt inserts for use in lifting the slab after it has been formed. For these purposes, before pouring cement into the assembled form, standard tripod chairs, for holding the rebar, are placed upright on the sand, within the area bounded by the assembled form. The rebar is preferably installed criss-crossed, on 2 foot centers approximately 2 inches above the sand bed, for a 4 inch thick slab.

Figure 10:
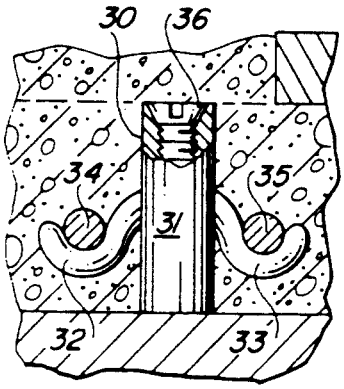
FIG. 10 is a cross-sectional view, taken along line 10—10 of FIG. 7, showing an installed insert for receiving an eyebolt, and accompanying rebars.
Figure 11:
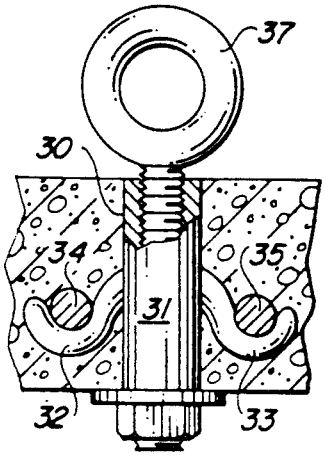
FIG. 11 is a cross-sectional view, similar to FIG. 10, but including the installed eyebolt.
Figure 12:
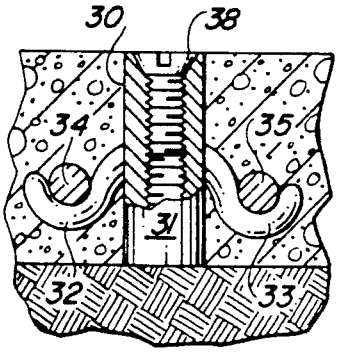
FIG. 12 is a cross-sectional view, similar to FIG. 11, but showing the eyebolt replaced with a finishing bolt.

Also, to provide anchored eyelet inserts for lifting the slab, a combination rebar and eyelet insert chair 30 may be placed adjacent the four corners of the slab, as best shown in FIGS. 10, 11 and 12. The chair 30 comprises a vertical, internally threaded stem 31 having depending hook arms 32 and 33, which serve as a support for rebars 34 and 35. In the preferred arrangement, four chairs 30 are used for a slab, each chair being positioned within the form area equidistant from each corner of the form, spaced inwardly approximately 2 feet from the edge of the form. For a 4 inch thick concrete slab, the chairs 30 are designed so that the hook arms 32 and 33 hold the rebar 2 inches above the sand base.

When the chairs and rebar have been installed, a suitable concrete mixture of desired color and texture is poured into the form, and the cement surface is floated and leveled. Prior to the pour, a protective bolt 36 is screwed into each of the threaded stems to prevent their filling with concrete. As shown in FIG. 10, the cement is floated and leveled so that the surface is flush with the top of the threaded stem 31. After the concrete has cured, the form sections are readily removed by disengaging the drift pins 21 and pulling the form sections from the hardened concrete.

The resultant cement slab may be transported by removing the protective bolts 36 from each of the threaded inserts 31, which have now become securely anchored in the cement, and screwing an eyebolt 37 in its place, as shown in FIG. 11. A boom truck hoist may then be attached to the eyebolts 37, and used to transport the slab to a different location or to set the slab in place in the patio, driveway or other surface being prepared. When set in place, the eyebolts 37 may be removed and replaced by cosmetic bolts 38, as shown in FIG. 12.

Figure 13:
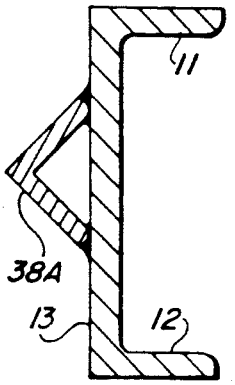
FIG. 13 is a cross-sectional view of an embodiment of the invention in which the inwardly facing web of a form section is provided with a tongue-producing shoulder.
Figure 14:
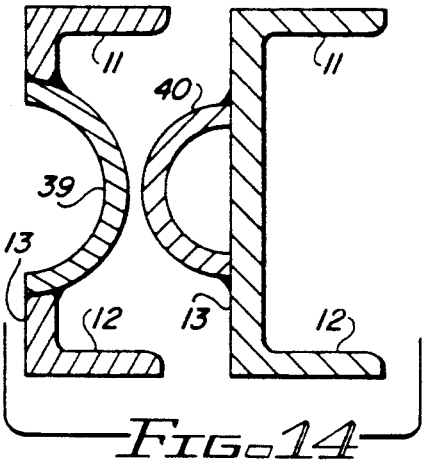
FIG. 14 is a cross-sectional view showing a form section with a different version of a groove-producing recession and a tongue-producing shoulder.
Figure 15:
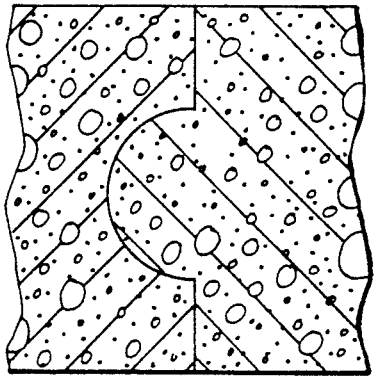
FIG. 15 is an end view of two adjacent concrete slabs locked together in the tongue and groove formation produced by the use of form sections illustrated in FIG. 14.

In another embodiment of the invention, illustrated in FIG. 13, the inwardly facing surface 13 of the form sections may be provided with a triangular groove-forming shoulder 38A. Also, as shown in FIG. 14, the face 13 of pairs of form sections may be provided with a tongue-forming recession 39 or a groove-forming shoulder 40, to produce concrete slabs which may be mated in the manner shown in FIG. 15.

Figure 16:
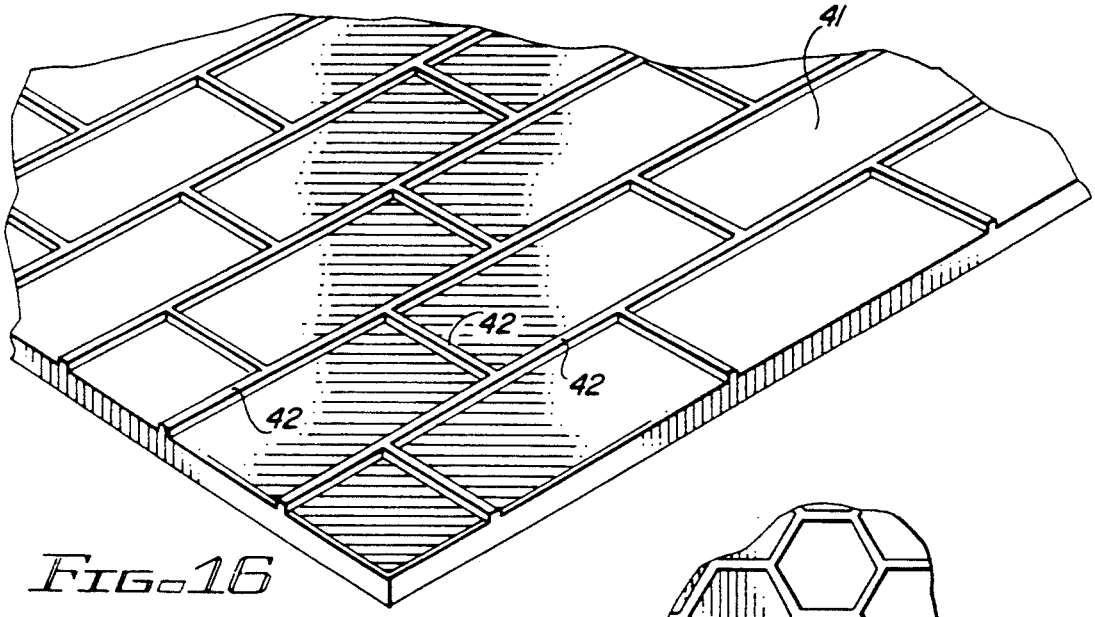
FIG. 16 is a perspective view of a bottom mold form for producing a pattern in the concrete slab.
Figure 17:
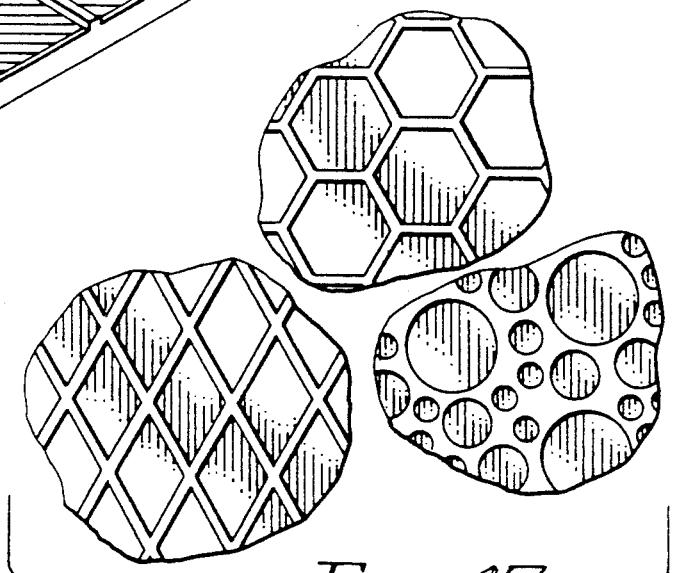
FIG. 17 is a top view of various patterns applied to the concrete slab, using bottom molds such as in FIG. 16.

In a further embodiment of the invention, shown in FIG. 16, a flat mold form is laid on the sand base prior to assembly of the form sections. The mold form has pattern-forming raised shoulders 42 which create a desired pattern in the surface of the concrete slab poured into the mold. Numerous varied patterns can be produced in the surface of the concrete slab in this manner, see FIG. 17. Alternative means for creating a pattern in the top surface of the slab may be used, such as pattern forms which are placed on the top surface and pressed into the concrete after floating and leveling.

The adjustable form apparatus of the present invention includes the following features which are significantly advantageous in terms of effectiveness and economy:

1. Use of an adjustable form in which all the form components are identical in shape and size provides substantial savings in work and money, since the inventorying of multiple components is avoided.
2. The form sections or components are simple and sturdy in construction, with no moving parts except a single drift pin.
3. The form is easy to assemble, merely by sliding each component to a measured point on the adjoining component, which it is held in place by the friction of an inserted drift pin. When concrete is poured into the form, the outward pressure of the concrete against the form sections increases the friction which secures the sections together.
4. The form sections are reusable indefinitely. Assembling and disassembling the form causes no damage or wastage.
5. The form sections are easily portable, so that concrete slabs may be cast either at a central location or at a construction site.
6. The form is readily adaptable for providing rabbeted mating edges, for use in shiplapping arrangement of adjoining slabs. The interlocking edges permit the slabs to be laid on any generally flat surface, without expensive compacting, cushioning, subflooring, or the use of adhesives or cements.
7. The adjustable form is conveniently used for the production of heavy slabs, which may be rebar reinforced and equipped with hoisting eyelet inserts for use with boom trucks in the transport and placement of the slabs.
8. The concrete slabs produced with the form are useful for patios, sidewalks, storage room or pump house floors, driveways, mobile home landings, and the like.
9. The adjustable form is useful on a smaller scale in the production of other materials which are normally cast in forms, such as tile, ceiling tile, wallboard, and the like.
10. Use of the form provides savings and flexibility for the consumer, since consumers with a budget can have patios or driveways constructed in stages as finances permit. When ready for the next stage, the adjustable forms permit the production of additional slabs having dimensions identical with those already installed.

Although various preferred embodiments of the invention have been described herein in detail, it will be understood by those skilled in the art that variations may be made thereto without departing from the spirit of the invention.

What is claimed is:

1. An adjustable device for producing concrete slabs comprising:

a plurality of identically configured channel shaped sections similarly oriented in interlocking arrangement to define a form unit;

each section including vertically spaced upper and lower arms and a vertical web connecting of said arms;

each section including a main body portion and a fork joint extension thereof on at least one end thereof;

said fork joint extension comprising upper and lower tines spaced apart at a distance substantially equal to the cross-sectional depth of said sections, so that the body portion of an adjoining section may be accepted between said tines;

said upper and lower tines each being provided with opposing holes in vertical registration with each other, said holes being spaced apart from the end of said main section body portion for a distance substantially equal to the effective cross-sectional width of an adjoining section, so that said adjoining section may be accepted between the end of said main body portion and said holes;

pins disposed through said opposing holes in said tines in each section, for retaining said adjoining section which is slidably accepted between said tines;

said interlocking arrangement of said plurality of sections being one in which the body portion of each section is inserted, at a predetermined point along its body, in a fork-jointed end of an adjoining section, to provide an enclosed geometric figure having predetermined dimensions.

2. An adjustable device as in claim 1 wherein said vertical web faces inwardly toward said geometric figure.

3. An adjustable device as in claim 1 wherein said geometric figure is a rectangle.

4. An adjustable device as in claim 1 wherein said geometric figure is a square.

5. An adjustable device as in claim 2 wherein said inwardly-facing vertical web is provided with a rabbet-forming shoulder, for producing concrete slabs useful in laying a shiplapped surface.

6. An adjustable device as in claim 2 wherein said inwardly-facing vertical web is provided with a tongue-forming recess, for producing concrete slabs useful in laying a tongue and grooved surface.

7. An adjustable device as in claim 1 wherein said upper and lower tines of said fork joint extension are each provided with a plurality of spaced apart, opposing holes, to accommodate adjoining sections having effective cross-sectional widths of varying dimensions.

8. An adjustable device as in claim 1, for producing concrete slabs having eyelet inserts anchored therein, wherein chairs for producing said eyelet inserts are placed at predetermined positions within said geometric figure.

9. An adjustable device for producing rectangular concrete slabs comprising:

four identically configured channel shaped sections similarly oriented in interlocking arrangement to define a rectangular form unit;

each section including vertically spaced upper and lower arms and a vertical web connecting said arms;

each section including a main body portion and a fork joint extension thereof on at least one end thereof;

said fork joint extension comprising upper and lower tines spaced apart at a distance substantially equal to the cross-sectional depth of said sections, so that the body portion of an adjoining section may be accepted between said tines;

said upper and lower tines each being provided with opposing holes in vertical registration with each other, said holes being spaced apart from the end of said main section body portion for a distance substantially equal to the effective cross-sectional width of an adjoining section, so that said adjoining section may be accepted between the end of said main body portion and said holes;

pins disposed through said opposing holes in said tines in each section, for retaining said adjoining section which is accepted between said tines;

said interlocking arrangement of said four sections being one in which the body portion of a first of said sections is inserted, at a predetermined point along its body, in a fork-jointed end of a second of said sections; the body portion of second section is inserted, at a predetermined point along its body, in a fork-jointed end of a third of said sections; the body portion of said third section is inserted at a predetermined point along its body, in a fork-jointed end of a fourth of said sections; and the body portion of said fourth section is inserted at a predetermined point along its body, in a fork-jointed end of said first section; to provide an enclosed square figure having predetermined dimensions.

10. An adjustable device as in claim 9 wherein said predetermined point along the body of said sections is the same in all four sections, whereby a square concrete slab is produced.

11. An adjustable device as in claim 9 wherein said vertical web faces inwardly toward said square figure.

12. An adjustable device as in claim 11 wherein said inwardly-facing vertical web on said sections is provided with a rabbet-forming shoulder, along the length thereof for producing concrete slabs useful in laying a shiplapped surface.

13. An adjustable device as in claim 11 wherein the said inwardly-facing vertical webs on two adjoining sections are provided with bottom rabbet-forming shoulders for producing undercut formations in two adjoining edges of said concrete slab, and the said inwardly-facing vertical webs on the other two adjoining sections are provided with upper rabbet-forming shoulders for producing uppercut formations in the other two adjoining edges of said concrete slab, for producing rectangular concrete slabs useful in laying shiplapped surfaces.

14. An adjustable device as in claim 11 wherein the said inwardly-facing vertical webs on two adjoining sections are provided with tongue-forming recesses for producing tongues in two adjoining edges of said concrete slab, and the said inwardly-facing vertical webs on the other two adjoining sections are provided with groove-forming shoulders for producing grooves in the other two adjoining edges of said concrete slab, for producing rectangular concrete slabs useful in laying tongue and grooved surfaces.

* * * * *

UNITED STATES PATENT AND TRADEMARK OFFICE

CERTIFICATE OF CORRECTION

PATENT NO. : 5,332,191

DATED : July 26, 1994

INVENTOR(S) : Terry L. Nolan

It is certified that error appears in the above-identified patent and that said Letters Patent is hereby corrected as shown below:

In Claim 1, column 7, line 16, "of" is deleted after the word "connecting".

Signed and Sealed this

Twenty-seventh Day of September, 1994

*Attest:*

Bruce Lehman

BRUCE LEHMAN

*Attesting Officer*

*Commissioner of Patents and Trademarks*